United States Patent [19]

Caron et al.

[11] Patent Number: 4,991,662

[45] Date of Patent: Feb. 12, 1991

[54] LAND FILL SPREADER BLADE ASSEMBLY

[75] Inventors: James O. Caron; Kenneth H. Pratt, both of Modesto, Calif.

[73] Assignee: Caron Compactor Company, Modesto, Calif.

[21] Appl. No.: 427,005

[22] Filed: Oct. 25, 1989

[51] Int. Cl.[5] ..... E02F 3/815

[52] U.S. Cl. ..... 172/701.1; 172/813; 172/833; 37/272; 37/276

[58] Field of Search ..... 172/701.1, 701.2, 701.3, 172/810–834; 37/108 R, 141 R, 266, 272, 275, 276, DIG. 5; 89/1.13

[56] References Cited

U.S. PATENT DOCUMENTS

| | | | |
|---|---|---|---|
| 2,740,213 | 4/1956 | Barrett | 172/812 |
| 3,121,964 | 2/1964 | Cobb | 172/701.1 X |
| 3,157,099 | 11/1964 | Ulrich | 172/815 |
| 4,158,923 | 6/1979 | Steiner et al. | 37/276 X |
| 4,731,942 | 3/1988 | Eberle | 37/272 |
| 4,779,363 | 10/1988 | Boutrais et al. | 172/815 X |

FOREIGN PATENT DOCUMENTS

| | | | |
|---|---|---|---|
| 124922 | 11/1984 | European Pat. Off. | 172/815 |

OTHER PUBLICATIONS

Skidder Photograph from Forestry Equip. Trade Show by Jack Toliver, Atlanta, Ga., 6–1975.

*Primary Examiner*—Randolph A. Reese
*Assistant Examiner*—Jeffrey L. Thompson
*Attorney, Agent, or Firm*—Flehr, Hohbach, Test, Albritton & Herbert

[57] ABSTRACT

A land fill spreader blade assembly characterized by a double "U" shape in plan for directing land fill materials into the demolition wheels or tracks carried by and supporting a tractor carrying the blade.

4 Claims, 2 Drawing Sheets

LAND FILL SPREADER BLADE ASSEMBLY

This invention pertains to means for managing a land fill of a type wherein substantial amounts of solid waste products or trash are deposited which need to be spread evenly around the area. More particularly, this invention pertains to a spreader blade for use in combination with demolition wheels or tracks carried by a tractor driven over such an area.

BACKGROUND OF THE INVENTION

In the management of a land fill site, bulldozers are conventionally employed for pushing trash and soil in various directions and for shaping the surface so as to establish the desired contour for the region. In addition trash compactor vehicles, either wheeled with deep cleats carried by the wheels, or of a crawler style having demolition and grouser blades on the tracks are useful in crushing and grinding the material of the land fill site into a spreadable state. The present invention represents a distinct improvement upon that approach. Thus, a spreader blade assists the compaction elements, such as the cleated wheels or tracks by positioning trash into the path of the compactor's wheels/tracks.

SUMMARY OF THE INVENTION AND OBJECTS

In general, a land fill spreader blade assembly is characterized by a double "U" shape as viewed in plan so as to direct land fill materials into the paths of demolition wheels or tracks carried by and supporting a tractor carrying the blade assembly. In addition, as disclosed herein, a blade extension portion is provided for extending the blade upwardly in order to prevent the trash from balling up and rolling over the top of the blade.

In general, it is an object of the present invention to provide an improved spreader blade particularly useful for land fill operations in conjunction with a tractor outfitted with demolition means, such as laterally spaced cleated wheels, or laterally spaced crawler tracks carrying demolition blades thereon.

It is another object of the present invention to provide an improved spreader blade whereby material which is spread by the blade will be deflected and deposited into the path of each of two laterally spaced demolition means so as to leave a minimum of loose uncompacted material therebetween.

It is yet a further object of the invention to provide an improved blade construction having means for inhibiting the trash and soil mixture from rolling over the top of the blade.

Another object of the invention is to provide an improved spreader blade having means for breaking up very large compacted collections of debris and dirt.

The foregoing and other objects of the invention will become more readily evident from the following detailed description of a preferred embodiment when considered in conjunction with the drawing.

DETAILED DESCRIPTION OF PREFERRED EMBODIMENT

Figure 1:
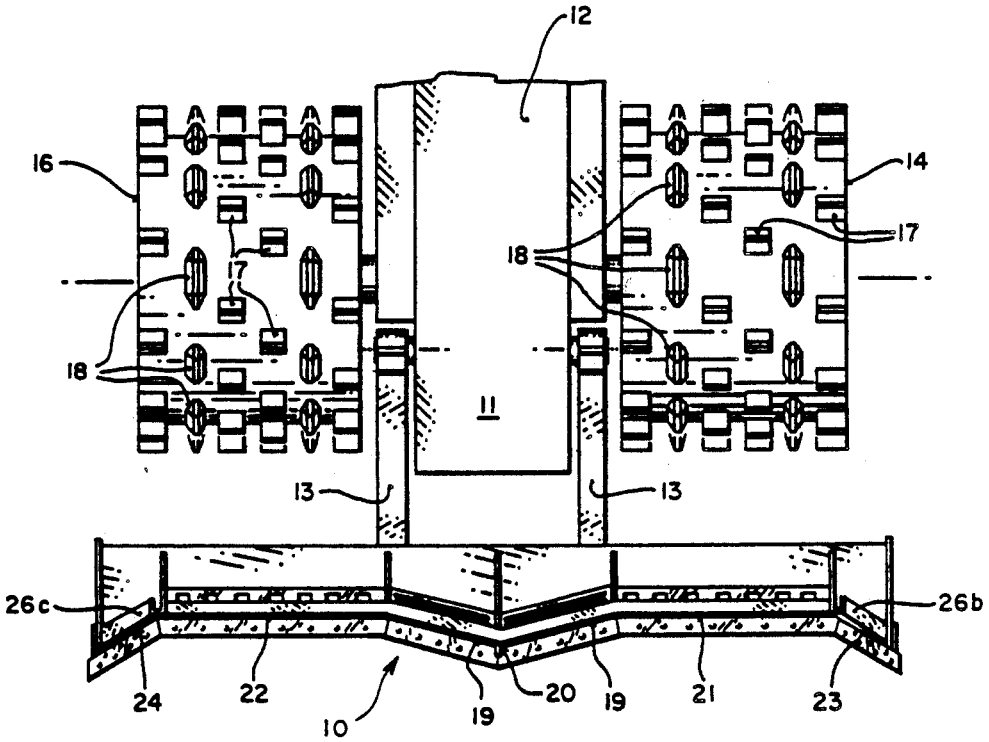
FIG. 1 shows a plan view of a front end portion of a tractor outfitted with demolition wheels and mounting a spreader blade according to the invention as shown in FIG. 3.
Figure 3:
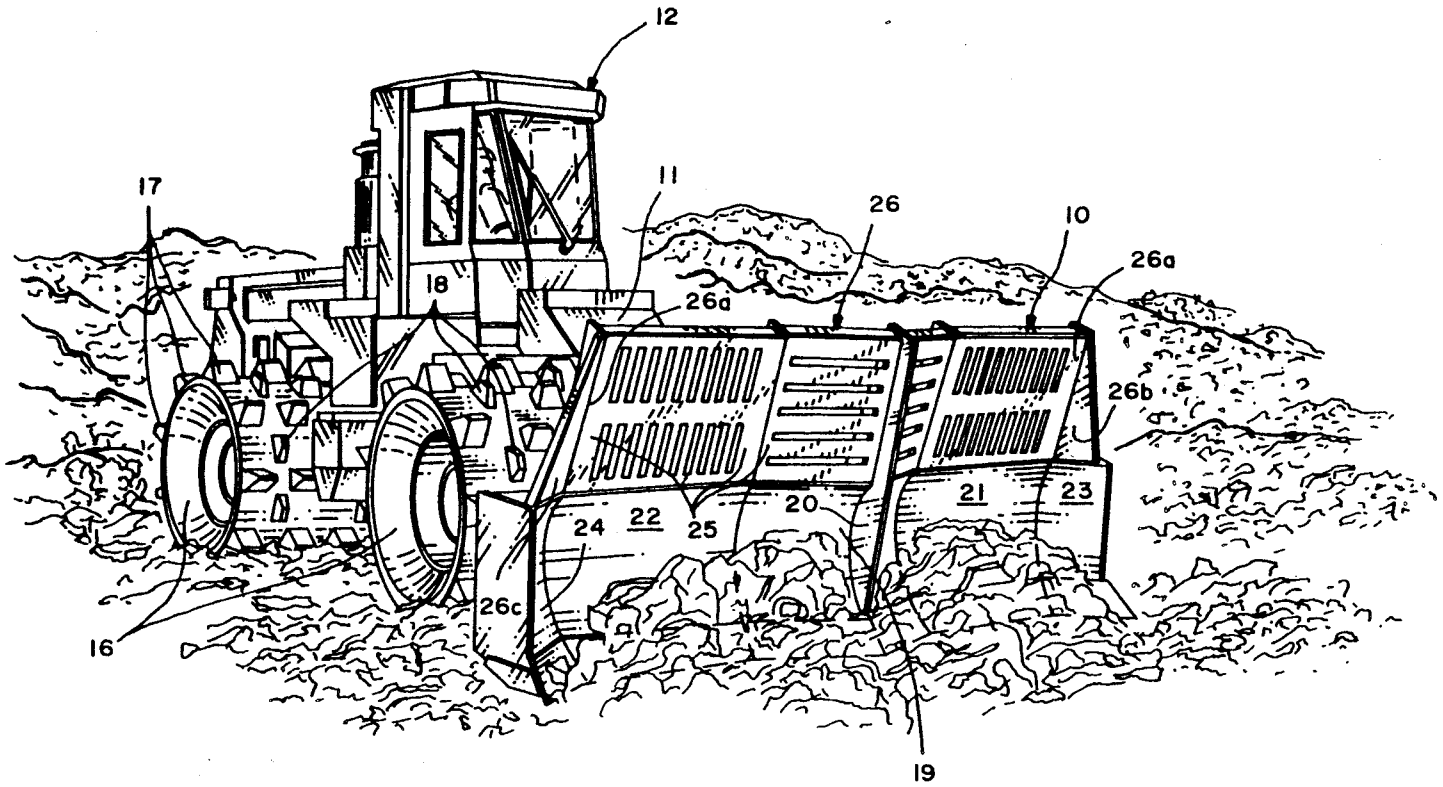
FIG. 3 is a three quater, lateral perspective view of a compaction tractor carrying the trash spreader blade of the present invention.

As shown in FIGS. 1 and 3, the front end 11 of a tractor 12 carries a conventional bulldozer mount 13 capable by known means of being raised and lowered selectively as desired by the operator of the tractor 12. The tractor 12 carries a pair of demolition wheels 14, 16 characterized by driving cleats 17 and demolition cleats 18 such as those disclosed in U.S. Pat. No. 3,922,108 granted Nov. 25, 1975. A land fill spreading blade assembly 10 serves to deflect trash to opposite sides of the center of the path of the tractor 12 thereby disposing the trash into the paths of the demolition wheels 14, 16 on opposite sides of the tractor 12. The blade assembly 10 includes a protruding "prow"-like central enlargement 19 protruding forwardly of the blade for deflecting the soil/trash mixture to opposite sides of the tractor's path.

Figure 2:
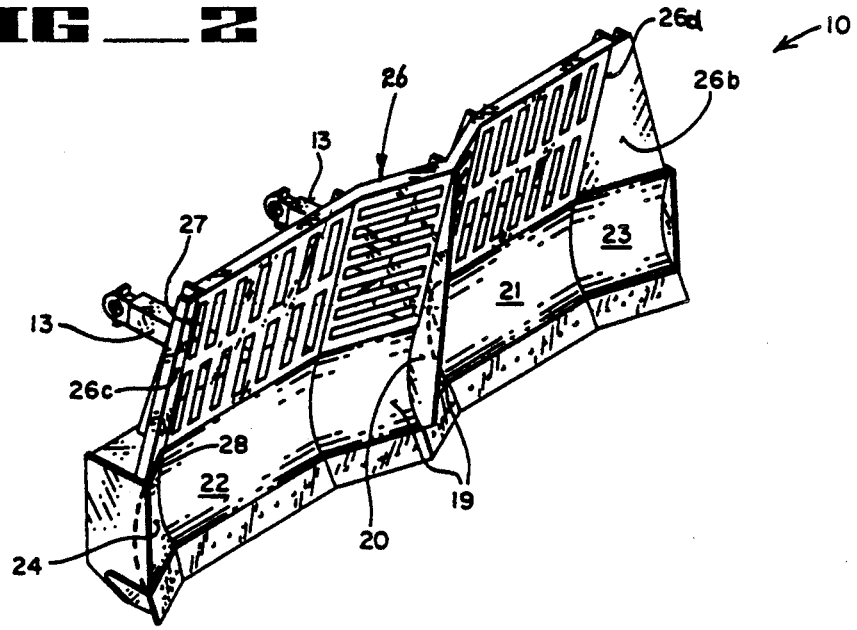
FIG. 2 shows a perspective view of a spreader blade construction according to the invention.

The blade 10 further includes relatively broad blade portions 21, 22 adjacent the prow-like portion 19 and extending transversely of the paths of the demolition wheels 14, 16. As may be seen in FIGS. 1 and 2, the broad blade portions 21, 22 merge with the centrally and forwardly arranged prow 19 which flares or tapers rearwardly into the portions 21, 22. In addition, forwardly directed end edges 23, 24 are formed on the ends of blade 10 for retaining trash to be spread in the region of the path of wheels 14, 16 whereby the demolition wheels will pass directly over the trash to achieve compaction. As shown best in FIG. 2, the end edge portions 23, 24 extend at an angle or taper rearwardly to merge into the broad blade portions 21, 22. The tendency to form a windrow along the blade edges is substantially reduced. When the blade assembly 10 is in use it is frequently maintained in a semi or slightly raised position, sometimes about 18 inches above the tractive surface. An upwardly and forwardly angled splitter blade 20 rigidly secured to blade assembly 10 substantially mid-way between the ends of blade assembly 10 serves to aid in breaking up "hardened" piles of refuse left by compactor trucks, and permits the spreading machine to strike compacted truck loads head-on rather than to break them up from the side. The splitter blade member 20 further serves to prevent the trash from shifting back and forth laterally of blade 10.

In operation, it will be evident that the load of soil and trash ahead of the blade 10 will build up laterally and upwardly. Accordingly, before the region in front of the two blade portions 21, 22 is substantially filled up, the blade is lifted to permit the trash to pass thereunder and be demolished by wheels 14, 16. The end portions 23, 24 which extend forwardly serve to retain the trash from spewing around the ends of blade 10. The end portions 23, 24 reduces the amount of trash formed as a "windrow" along the outside at each said end portion.

Means for preventing trash from accumulating and rolling up and over the blade 10 includes a rigid screen 26 extending upwardly from the upper edge of blade 10 and tipped to lean forwardly in order to deflect trash forwardly thereof. The screen 26 comprises a rectangular portion **26*a* formed from a number of rigid ribs fixed in spaced parallel relation and carried by frame members 25 disposed to lean forwardly at a slight angle. Triangularly shaped sheets 26*b*, 26*c* of impervious material secured at each end of the rectangularly shaped portion 26a is suitably secured by welding two adjacent edges 27, 28 of each sheet, respectively, to the top edge of blade 10 and to an end of the rectangular section 26a** of the screen. In this way, the screen's width is extended to prevent trash from rolling up and over the blade at the outer ends thereof.

In operation as the surface of a land fill site is smoothed or contoured, various portions of trash will surface and by means of blade 10 described above the trash and similar materials are moved laterally to a side of the blade. The driver of the tractor can then operate suitable hydraulic cylinders and hydraulic switching (all forming controls of known style and structure) to selectively lift the blade upwardly to permit the trash disposed in front of panels 21, 22 to be released and crushed under wheels 14, 16. Thereafter, the blade is lowered by the tractor driver for additional spreading and pushing of the mixture of soil and trash materials. Thus, the "double U" configuration of the blade assembly 10 serves to control the placement of trash into the path of each wheel/track for compaction. It will be further evident that the provision of a "U-38" shaped blade will greatly reduce the uncompacted central portion of the path of the compaction machine lying between the paths of the spaced wheels/tracks.

In addition to the above, the forwardly directed ends 23, 24 tend to contain such trash within the region lying in front of panels 21, 22, and wheels 14, 16.

In use, the trash blade spreads the trash for compaction by the trash compactor vehicle which can be either a wheeled or crawler machine. The blade is used for a spreading function as contrasted to a scooping function or digging function of a dirt moving machine, for example. The trash blade is operated in a somewhat elevated condition with respect to the grade upon which it is working, say for example, 8 to 18 inches above the grade for spreading trash. The objective is to spread the trash away from the center of the machine, and to place the trash in the pathway of the destructive compacting wheels (or tracks). This is more effective than leaving a path of uncompacted trash running beneath the machine as is the case with existing blades. Thus as the spreader blade moves the trash while the blade is in a somewhat elevated condition, the trash is pushed and confined to the paths of the wheels or tracks for compaction. Very little trash is distributed to the central portion of the blade where it would pass between the demolition wheels 14, 16 or tracks and remain on the ground in an uncompacted state.

What is claimed is:

1. A land fill spreader blade assembly of a type serving to deflect trash to opposite sides of the center line of the path of a tractor and into the paths of demolition wheels carried on opposite sides of the tractor, said blade assembly comprising means protruding forwardly of the blade for deflecting trash to opposite sides of the center line of the tractor's path, broad blade portions extending transversely of the paths of the demolition wheels, forwardly directed portions formed on the ends of said blade for retaining trash in the region of the paths of said wheels, said forwardly protruding means flaring rearwardly and laterally to merge with said broad blade portions and said forwardly directed end portions tapering rearwardly and laterally to merge with said broad blade portions whereby the blade is so configured that the demolition wheels will pass directly over the trash, and a rigid screen extending upwardly from the upper edge of said blade serving to deflect trash forwardly thereof, and means supporting said blade assembly with respect to the leading portion of the tractor.

2. In combination a tractor and a land fill spreader blade assembly of a type serving to deflect trash to opposite sides of the center line of the path of said tractor and into the paths of demolition wheels or continuous articulated tracks carried on opposite sides of said tractor, said blade assembly comprising a prow-like central enlargement protruding forwardly of the blade for deflecting trash to opposite sides of the center of said tractor's path, broad blade portions extending transversely of the paths of said demolition wheels or continuous tracks, inwardly directed end portions formed on the ends of said blade for retaining trash in the region of the path of said wheels, said prow-like central enlargement flaring rearwardly and laterally to merge with said broad blade portions and said end portions projecting forwardly of said broad blade portions, whereby the blade is so configured that said demolition wheels will pass directly over the trash, and a rigid screen extending upwardly from the upper edge of said blade assembly with respect to the leading portion of the tractor to be worked between raised and lowered positions.

3. A land fill spreading blade assembly according to claim 1 in which said screen comprises a rectangular portion as viewed in front elevation, said screen being formed from a number of spaced ribs disposed in laterally spaced parallel relation and disposed to lean forwardly at a slight angle, a triangularly shaped sheet of impervious material secured at each end of said rectangularly shaped portion, two adjacent edges of each said sheet being welded respectively to the top edge of said blade and to an end of said rectangular portion, thereby extending the width of said screen to prevent trash from rolling up and over said blade.

4. A land fill spreading blade assembly as in claim 1 comprising an upwardly mounted elongate splitter blade rigidly secured to said spreader blade in the region of said protruding means, said splitter blade being relatively thin and rigid to aid in breaking up compacted piles of refuse by driving said blade assembly head-on into such piles of refuse.

* * * * *